US007765947B2

(12) United States Patent
Thompson et al.

(10) Patent No.: US 7,765,947 B2
(45) Date of Patent: Aug. 3, 2010

(54) DECK CONFIGURATION FOR OCEAN BOTTOM SEISMOMETER LAUNCH PLATFORMS

(75) Inventors: James N. Thompson, Sugar Land, TX (US); Jerry L. Laws, Huntsville, TX (US); Roger L. Fyffe, Sugar Land, TX (US)

(73) Assignee: Fairfield Industries Incorporated, Sugar Land, TX (US)

( * ) Notice: Subject to any disclaimer, the term of this patent is extended or adjusted under 35 U.S.C. 154(b) by 0 days.

(21) Appl. No.: 11/899,859

(22) Filed: Sep. 7, 2007

(65) Prior Publication Data

US 2008/0041296 A1 Feb. 21, 2008

Related U.S. Application Data

(62) Division of application No. 11/120,074, filed on May 2, 2005.

(51) Int. Cl.
*G01V 1/38* (2006.01)

(52) U.S. Cl. ..... 114/382; 367/15

(58) Field of Classification Search ..... 367/15–24; 114/255, 244; 414/140.3, 141.3, 141.5, 142.6; 405/190, 191; 181/110, 112, 104, 118
See application file for complete search history.

(56) References Cited

U.S. PATENT DOCUMENTS

| | | | | |
|---|---|---|---|---|
| 2,440,306 | A | 4/1948 | Smith | |
| 2,963,310 | A | 12/1960 | Abolins | |
| 4,270,598 | A | 6/1981 | Britton | |
| 4,655,153 | A | 4/1987 | Bel | |
| 4,716,848 | A | 1/1988 | Smith et al. | |
| 7,210,556 | B2 | 5/2007 | Bath et al. | |
| 2003/0218937 | A1* | 11/2003 | Berg et al. | 367/16 |
| 2005/0052951 | A1* | 3/2005 | Ray et al. | 367/188 |
| 2006/0120216 | A1 | 6/2006 | Ray et al. | |

OTHER PUBLICATIONS

Swinehart, Ed, International Search Authority/US, International Search Report, Mar. 19, 2008, 2 pages, United States Patent Office Cooperation Treaty, Alexandria, Virginia.

Swinehart, Ed, International Search Authority/US, Written Opinion of the International Searching Authority, Mar. 19, 2008, 5 pages, United States Patent Office Cooperation Treaty, Alexandria, Virginia.

* cited by examiner

*Primary Examiner*—Ed Swinehart
(74) *Attorney, Agent, or Firm*—Haynes and Boone, LLP

(57) ABSTRACT

A configuration for the deck of a marine vessel, wherein parallel and perpendicular travel paths, for movement of individual OBS unit storage baskets, are formed along a deck utilizing, in part, the storage baskets themselves. A portion of the deck is divided into a grid defined by a series of low-to-the-deck perpendicular and parallel rails and each square in the grid is configured to hold an OBS unit storage basket. Around the perimeter of the grid is an external containment wall which has a greater height than the rails. Storage baskets seated within the grid are configured to selectively form internal containment walls. Opposing internal and external containment walls define travel paths along which a storage basket can be moved utilizing a low, overhead gantry. A basket need only be lifted a minimal height above the deck in order to be moved along a path. The containment walls and the deck itself constraining uncontrolled swinging of baskets, even in onerous weather or sea conditions. The system is flexible to meet the needs of a desired operation since the internal walls of the grid can be reconfigured as desired in order to free up a particular storage basket or define a particular travel path.

13 Claims, 2 Drawing Sheets

DECK CONFIGURATION FOR OCEAN BOTTOM SEISMOMETER LAUNCH PLATFORMS

CROSS-REFERENCE TO RELATED APPLICATION

The present application is a divisional of and claims priority to U.S. patent application Ser. No. 11/120,074, entitled, "Deck Configuration for Ocean Bottom Seismometer Launch Platforms to the Field Of Seismic Exploration," filed on May 2, 2005, which is hereby incorporated by reference.

BACKGROUND OF THE INVENTION

The present invention relates to the field of seismic exploration. More particularly, the invention relates to a deck configuration for an ocean bottom seismometer launch platform and most particularly, the invention relates to a deck configuration that enhances the handling and manipulation of the multiplicity of ocean bottom seismometers that are typically deployed and retrieved in deep marine seismic exploration operations.

Seismic exploration operations in marine environments typically are conducted from the deck of one or more seismic exploration vessels, such as floating platforms or ships. While the fundamental process for detection and recording of seismic reflections is the same on land and in marine environments, marine environments present unique problems due to the body of water overlaying the earth's surface, not the least of which is moving personnel and equipment to a site and maintaining them there for an extended period of time. In this same vein, even simple deployment and retrieval of seismic receiver units in marine environments can be complicated since operations must be conducted from the deck of a seismic exploration vessel where external elements such as wave action, weather and limited space can greatly effect the operation.

These factors have become even more significant as exploration operations have moved to deeper and deeper water in recent years, where operations require longer periods of time "at sea." Among other things, exploration in deep water has resulted in an increased reliance on seismic receiver units that are placed on or near the seabed. These devices are typically referred to as "OBC" (Ocean Bottom Cabling) or "OBS" (Ocean Bottom Seismometer) systems. Most desirable among these ocean bottom systems are OBS system known as Seafloor Seismic Recorders (SSR's). These devices contain seismic sensors and electronics in sealed packages, and record seismic data on-board the units while deployed on the seafloor (as opposed to digitizing and transmitting the data to an external recorder). Data are retrieved by retrieving the units from the seafloor. SSRs are typically re-usable.

In a typical operation, hundreds if not thousands of OBS units are deployed in a seismic survey. For SSRs, these units must be tracked, charged, deployed, retrieved, serviced, tested, stored and re-deployed all from the very limited confines of the deck of the surface vessel. Because of the large number of OBS units that must be handled, additional surface vessels may be employed. Additional surface vessels are costly, as are the personnel necessary to man such vessels. The presence of additional personnel and vessels also increases the likelihood of accident or injury, especially in deep water, open-sea environments where weather can quickly deteriorate.

One particular problem that arises in offshore seismic operations is the manipulation and movement of these OBS units on a vessel's launch/recovery deck when weather and ocean conditions are onerous. Typically an overhead crane on a vessel's deck is utilized to grasp and move equipment from one location to another, such as moving OBS units from a storage area to a launch area. These cranes are generally tower cranes that must lift a load relatively high above the deck in order to clear other equipment and structures on the deck. However, those skilled in the art understand that as such equipment is lifted clear of the deck, it will have a tendency to swing on the gantry's lifiting line, which can create a safety hazard. This is especially problematic for a vessel operating in rough seas or windy conditions. In such cases, operations may have to be suspended until they can be conducted without endangering personnel, equipment or both.

Nowhere in the prior art is there described a launch/recovery deck system for handling the above-described OBS units, ancillary equipment and operations, whether it be storage of the units or deploying and retrieving the units or any other equipment associated therewith, such as Remote Operated Vehicles ("ROVs") that might be used in the operations. As the size of deep water seismic recorder arrays becomes larger, a system for efficiently and safely storing, tracking, servicing and handling the thousands of recorder units comprising such an array becomes more necessary.

Thus, it would be desirable to provided a system on the deck of an OBS deployment/retrieval vessel for efficiently handling the hundreds or thousands of OBS units that can comprise an array. Such a system should permit the safe handling and efficient movement of OBS units and their storage containers along the deck, even under. adverse weather or ocean conditions. Such a system should facilitate the deployment, retrieval, tracking, maintenance and storage of OBS units, while minimizing manpower and the need for additional surface vessels. The system should likewise minimize potential damage to the individual units during such activity.

SUMMARY OF THE INVENTION

The present invention provides a unique, efficient and safe configuration for the deck of an OBS deployment marine vessel, wherein parallel and perpendicular travel paths for movement of OBS unit storage baskets are formed along a deck utilizing, in part, the storage baskets themselves. More specifically, a portion of the deck is divided into a grid defined by a series of perpendicular and parallel rails and each square in the grid is disposed for receipt of a storage basket in which a plurality of OBS units are housed. The height of the rails need only be sufficient to prevent a storage basket seated within a grid square from shifting. Around the perimeter of the grid is an external containment wall which has a greater height than the rails. Storage baskets seated within the grid form internal containment walls within the grid. An overhead gantry is disposed to move over the top of the grid. The external containment walls and internally formed storage basket containment walls are positioned to form travel paths through which the overhead gantry can move individual baskets. The gantry need only lift a basket a sufficient height to clear the height of the rails defining the grid square in which the basket is seated, which is preferably only several inches. As a basket is moved through the grid along a particular travel path from its storage location to a servicing location, uncontrolled swinging of the basket is inhibited by the containment wall and the "wall" formed by the other containment baskets. Furthermore, since the basket need only be lifted inches above the deck itself in order to be moved through the grid, uncontrolled swinging is also prevented by the deck itself since the width and depth of the basket are much greater than the height of the basket above the deck. In another embodiment of the invention, poles or similar structures may be utilized to form a part of the travel path for movement of individual storage baskets when the desired travel path is not adjacent external and internal containment walls.

The travel paths formed by the internal walls, the external walls and the poles permit storage baskets to be moved from a storage location within the grid to various stations for OBS unit charging, data extraction and maintenance, as well as stations where the individual OBS units can be moved between the storage basket and a deployment/retrieval vehicle or mechanism. In one embodiment of the invention, each storage basket contains a plurality of seats for receipt of OBS units. Each seat is disposed to orient an OBS unit disposed therein for various servicing activities such as. seismic data retrieval, charging, testing, and synchronization.

DESCRIPTION OF THE PREFERRED EMBODIMENTS

Figure 1:
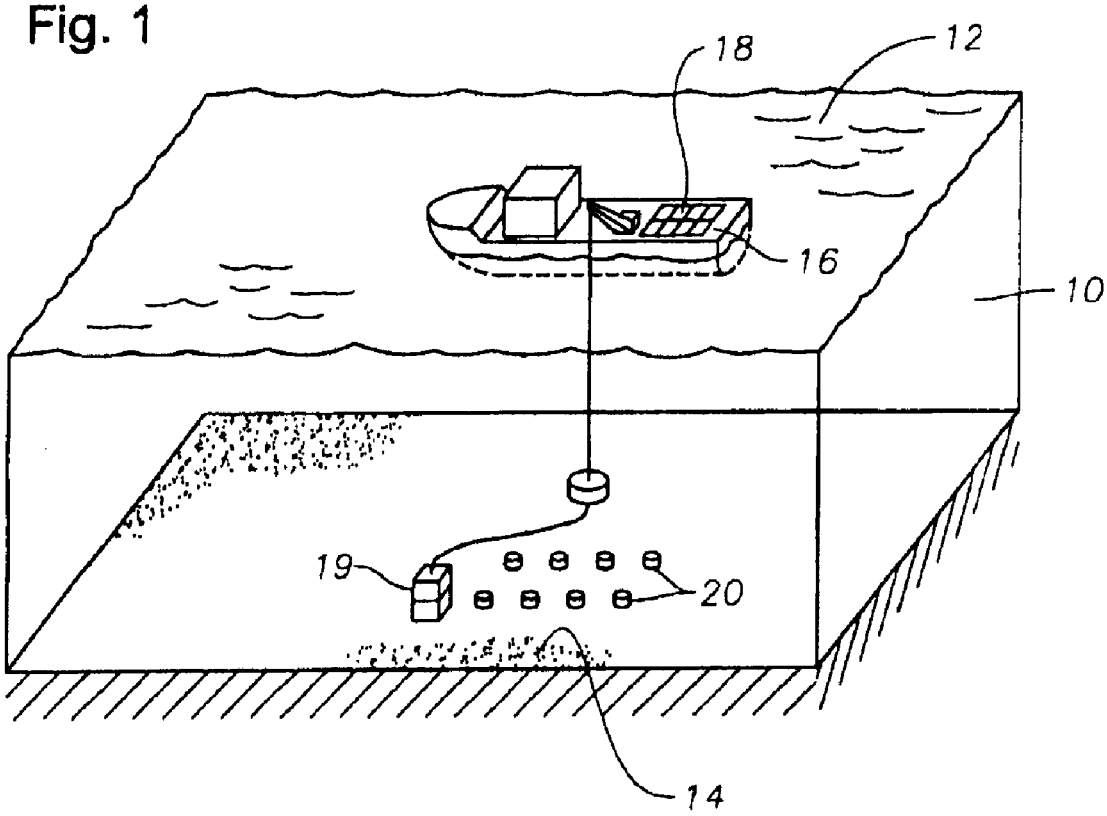
FIG. 1 is a schematic view of seismic operations in deep waters showing deployment of OBS receiver units from the deck of a seismic exploration vessel.

With reference to FIG. 1, there is shown a body of water 10 having a surface 12 and a seabed 14. A vessel or operations platform 16 is positioned on the surface 12 of the water 10. Vessel 16 is provided with a deck 18 from which ocean bottom seismic receiver units 20 are deployed and retrieved. Such deployment and retrieval operations may utilize a remotely operated vehicle ("ROV") or similar device 19 which is also operated from deck 18.

Figure 2:
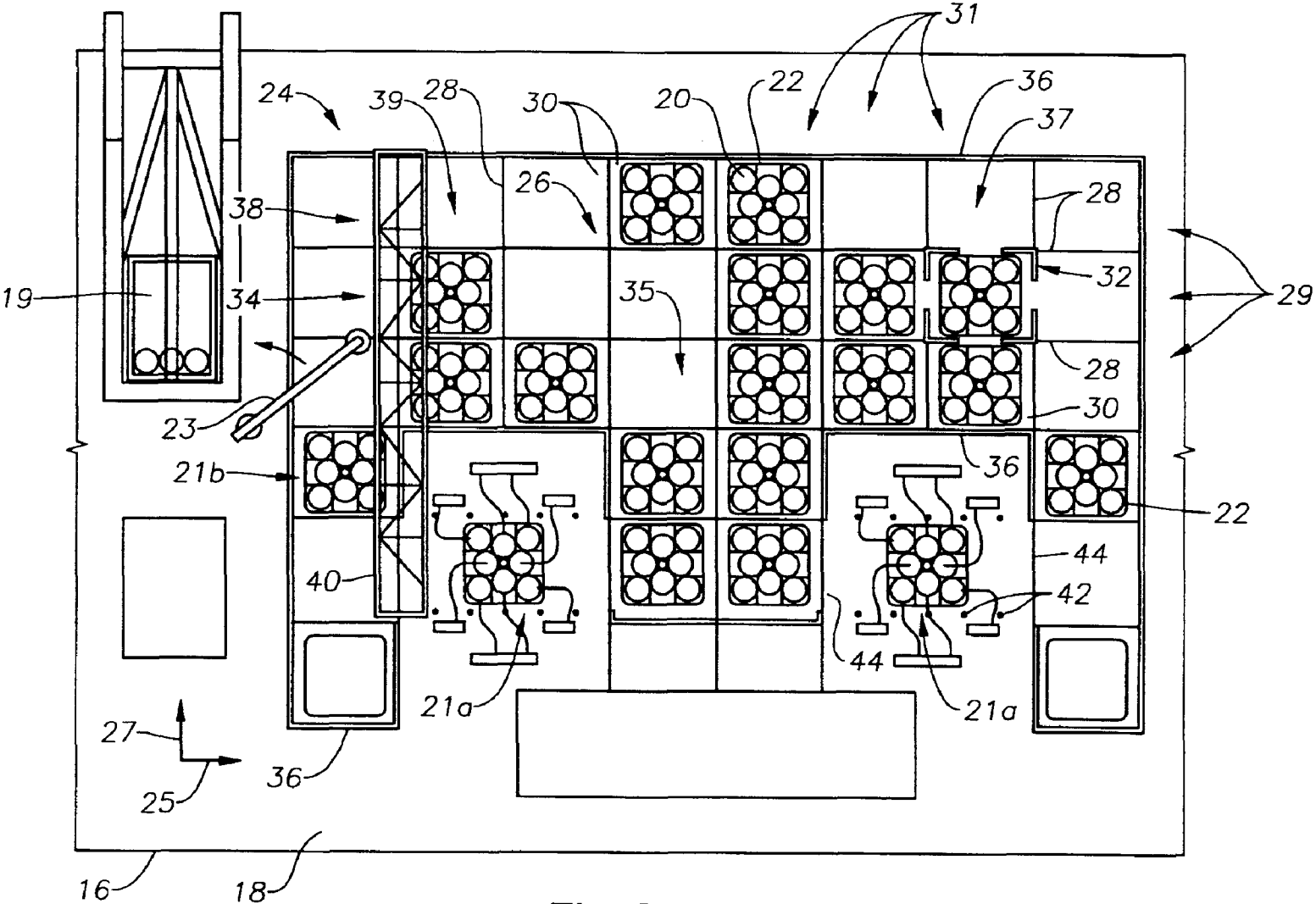
FIG. 2 is a top view of the deck layout illustrating the configuration of storage grids and travel paths for manipulating OBS unit storage baskets.

FIG. 2 illustrates the layout of the deck 18 on which is positioned a plurality of OBS unit storage baskets 22. Each storage basket 22 is disposed to hold a plurality of OBS units 20. In the preferred embodiment, each storage basket 22 is configured to have five levels of eight OBS units 20 per level, for a total of forty OBS units 20 per basket 22. By way of example only, in a deep sea seismic operation utilizing 920 nodes, 23 storage baskets would be required to be arranged and positioned on deck 18. In this preferred embodiment, each storage basket 22 is 6 feet long, 6 feet wide and 5 feet high.

Defined on deck 18 is a storage area 24 for storage of baskets 22. Preferably positioned within storage area 24 are stations 21 at which OBS units 20 can be manipulated for various desired purposes. For example, it may be desirable to provide a station for extracting data from OBS units 20 once they have been retrieved from ocean floor 14. In the illustration of FIG. 1, there are shown charging/data link stations 21*a* and deployment/retrieval stations 21*b*. With respect to the location of a station 21*a*, while it can be positioned at any point along deck 18 so long as basket movement is constrained in accordance with the invention, station 21*a* is preferably centrally located within storage are 24. Additionally, it has been found to be preferable to at least partially enclose station 21*a* in an air conditioned environment. The chargers generate a great deal of heat and such a controlled environment allows the chargers to be more easily cooled, but also isolates that station in the event of fire or similar hazards. With respect to deployment station 21*b*, a deployment arm 23 is provided that can move individual OBS units 20 between a basket 22 and ROV 19.

Storage area 24 is characterized by a grid 26 formed by a series of spaced apart perpendicular and parallel rails 28 that define cells or seats 30. For purposes of reference, grid cells 30 are aligned along an x-axis 25 and a y-axis 27 to form a plurality of x-axis rows 29 and a plurality of y-axis rows 31. Each grid cell 30 is disposed for receipt of a storage basket 22. In the preferred embodiment, rails 28 are only several inches in height above deck 18. Rails 28 need not be formed of any particular material or have any particular shape. In one example, rails 28 may be formed of standard 2 inch angle iron. In another example, rails 28 may be formed of rubber bumpers. Likewise, rails 28 need not be continuous, but may be intermittent so long as they create a "seat" for receipt of a storage basket 22. Thus, in one preferred embodiment, rails 28 may be positioned only at the corners of a cell 30, such as is illustrated at 32, or only along a portion of the sides of cell 30. In any event, the height of rails 28 need only be of sufficient height to ensure that a storage basket 22 securely seats within a cell 30 thereby preventing the storage basket from shifting or tipping.

By seating a plurality of storage baskets 22 adjacent one another along an x-axis row 29 or a y-axis row 31, a wall 34 of storage baskets 22 can be formed. Because each storage basket 22 that comprises wall 34 is securely seated within their respective cells 30 and because each storage basket 22 desirably has a low center of gravity, each wall 34 is relatively stable. For purposes of the description, wall 34 may in some cases only comprise a single storage basket so long as it provides the intended function as more specifically described below.

An external containment wall 36 is defined around the perimeter of grid 26. In the preferred embodiment, external containment wall 36 has a greater height than rails 28. External containment wall 36 is likewise aligned along x-axis 25 and y-axis 27 to be parallel and perpendicular with walls 34, as the case may be, thereby forming open travel paths 38 for movement of storage baskets 22. The height of containment wall 36 is preferably commensurate with the height of walls 34. In one preferred embodiment, the height of external containment wall 36 is three feet.

An overhead gantry or bridge crane 40 is positioned on deck 18 to operate along the x-axis 25 and y-axis 27 over the top of the grid 26 to move individual storage baskets 22 along a travel path 38 between stations 21 and storage locations within grid 26. Gantry 40 is capable of moving baskets 22 along both x-axis rows 29 and y-axis rows 31. Furthermore, gantry 40 is itself only a sufficient height above deck 18 necessary clear the walls 34 formed by storage baskets 22. In one preferred embodiment, gantry 40 is only eleven feet above deck 18. Because gantry 40 is disposed to move baskets 22 along travel paths 38, gantry 40 need not be capable of lifting a basket 22 above walls 34. Rather, gantry 40 need only lift a basket 22 a sufficient height above deck 18 to clear the height of rails 28. Thus, in one preferred embodiment gantry 40 need only lift a basket 22 approximately three inches above deck 18 in order to move basket 22 along a travel path 38. In another embodiment, basket 22 need be lifted no more than three feet above the deck while in another embodiment, basket 22 need be lifted no more than six feet above the deck. As a basket 22 is moved through grid 26 along a travel path 38, uncontrolled swinging of basket 22 is inhibited by external containment wall 36 and "internal" wall 34. 38. Furthermore, since basket 22 need only be lifted a short height above deck 18 in order to be moved through grid 26, swinging movement of basket 22 is also prevented by deck 18 since the width and length of basket 22 are much greater than the height of basket 22 above deck 18.

In the preferred embodiment, gantry 40 includes a gantry head (not shown) capable of rotating each OBS unit 22 so that it will be properly oriented in basket 22 to permit charging, data extraction, etc.

Those skilled in the art will understand that desired travel paths 38 can be defined within grid 26 by placement of baskets 22 within specific cells 30. Such travel paths 38 can be defined along either an x-axis row 29, a y-axis row 31 or both. Baskets 22 can be moved around within grid 26 as necessary to create additional travel paths 38 or to access different baskets 22. Furthermore, travel paths 38 can be formed internally within grid 26 between opposing walls 34, such as is illustrated at 35, or adjacent the perimeter of grid 26 between external wall 36 and internally formed wall 34, as is illustrated at 37. In this regard, as indicated above, an internally formed wall 34 can be formed of a single basket 22, such as is shown at 39, so long as the wall provides the constraint functions described above.

In another embodiment of the invention, poles or similar structures 42 may be utilized to form a part of travel path 38 for movement of individual storage baskets 22 when the desired travel path is not bounded by external containment walls 36 or "internal" walls 34. In the illustrated embodiment of FIG. 2, a charging/data link station 21*a* is positioned on deck 18 adjacent grid 26. An opening 44 is defined in external wall 36 to permit a basket 22 to be moved "outside" of grid 26. A row of poles 42 is provided on either side of opening 44 between opening 44 and station 21*a*. In a similar manner to external walls 36 and "internal" walls 34, poles 42 are used to constrain swinging movement of baskets 22 as they are moved between station 21 and grid 26. In the illustration, an opening 46 is also provided in another portion of containment wall 36 and poles 42 are accordingly positioned so as to permit baskets 22 to be cycled through station 21*a* in rotation.

Those skilled in the art will understand that storage area 24 is scalable to meet the particular OBS unit storage needs and space limitations of a vessel. In FIG. 2, storage area 24 has thirty-four cells 30 available for use, preferably to accommodate twenty three storage baskets or 920 OBS units. Of course, in order to permit "shifting" of baskets, not all cells are occupied by a storage basket. Desirably, in any given grid, at least 30% of the cells are open or unoccupied to facilitate movement of storage baskets and creation of travel paths. Furthermore, the number of baskets or OBS units that can be stored in a storage area will also vary depending on the storage capabilities of the baskets and the size of OBS units. Specific numbers and dimensions set forth herein are for illustrative purposes only and are not intended to be a limitation of the invention. In addition, while the system has been described primarily utilizing a linear grid, it is understood that the system is also compatible with other configurations, including non-linear configurations, so long as the storage baskets are utilized to form containment walls as described herein.

In one preferred embodiment parallel and perpendicular rails 28 that form grid 26 are configured to have the dimensions of a standard 8'×20'×8' shipping container so that each 8' section of storage area 24, as well as any baskets 22 and OBS units 22 stored therein, can be easily transported utilizing standard container ships, and quickly assembled on the deck of any standard seismic vessel. To further facilitate transport to a staging or assembly location, baskets 22 may also be stackable. Likewise, the stations 21 and other components can be modular, preferably with dimensions of standard shipping containers, to facilitate assembly on deck 18.

The travel paths formed by the internal walls, the external walls and the poles permit a storage basket to be moved much more safely between storage locations within a storage grid and various stations on the vessel's deck while maintaining maximum control over movement of the storage basket. This is particularly desirable in the case of onerous weather conditions. The poles, external containment wall and "internal" walls formed by rows of storage baskets constrain swinging of baskets, even in conditions where the surface vessel itself may be moving significantly. Furthermore, since the "internal" walls of the grid can be reconfigured as desired in order to free up a particular storage basket, the system is very flexible to meet the needs of a desired operation. Various stations can be integrated with the system, such as stations for OBS unit charging, data extraction and maintenance, as well as stations where the individual OBS units can be moved between the storage basket and a deployment/retrieval vehicle or mechanism.

What is claimed is:

1. A method of deploying OBS units from a marine vessel into the water, said method comprising the steps of:

a. providing a plurality of containers arranged in a first storage location on the deck of said marine vessel;

b. providing a plurality of OBS units in said plurality of containers disposed in said first storage location;

c. providing an overhead gantry crane disposed on said deck;

d. utilizing said overhead gantry crane to move one of said containers having said plurality of OBS units along a travel path from said first storage location on said deck to a second deployment location on said deck;

e. providing an ROV adjacent said second deployment location, wherein said ROV is capable of carrying a plurality of OBS units;

f. individually moving a plurality of OBS units from a position in said container to said ROV; and g. launching said ROV into the water.

2. The method of claim 1, wherein a first portion of said containers are arranged adjacent one another to form a first row and a second portion of said containers are arranged adjacent one another to form a second row perpendicular to said first row, wherein said OBS units are stacked in a plurality of levels in said storage containers;

wherein said overhead gantry is configured for movement in a direction perpendicular and parallel to said rows of containers;

wherein said container is lifted no more than six feet above the deck when it is moved from the first location to the second location.

3. The method of claim 1, wherein said containers are arranged adjacent one another in said first location to form a row of containers, wherein said OBS units are stacked in a plurality of levels in said storage containers;

wherein said overhead gantry is configured for movement in a direction perpendicular and parallel to said rows of containers;

wherein said container is lifted no more than six feet above the deck when it is moved from the first location to the second location.

4. The method of claim 3, further comprising the steps of:

a. moving a container having a plurality of OBS units disposed therein to a third location on said deck;

b. extracting data from a plurality of OBS units within said container at said third location; and c. moving said container back to the first storage location.

5. The method of claim 3, further comprising the steps of:

a. moving a container having a plurality of OBS units disposed therein to a third location on said deck;

b. charging batteries for a plurality of OBS units within said container at said third location; and c. moving said container back to the first storage location.

6. The method of claim 1, wherein the step of moving said container with said overhead gantry comprises lifting the container no more than 6 feet above the deck.

7. The method of claim 1, wherein the step of providing an overhead gantry crane comprises constraining said overhead gantry crane to linear movement over the top of said containers.

8. The method of claim 1, wherein the travel path is defined in part by a portion of said plurality of containers positioned on said deck in said first location.

9. The method of claim 8, wherein said travel path is selectively altered by altering the position of the portion of said plurality of containers on said deck.

10. A method of deploying OBS units from a marine vessel into the water, said method comprising the steps of:

a. providing a plurality of containers arranged in a first storage location on the deck of said marine vessel;

b. storing providing a plurality of OBS units in at least one of said plurality of containers disposed in said first storage location;

c. providing an overhead gantry crane on said deck and constrained to linear movement over the top of said containers;

d. defining a travel path on said deck extending from said first storage location on said deck to a second deployment location on said deck by providing containment structures on either side of at least a portion of said travel path;

e. utilizing said overhead gantry crane to move said container containing said plurality of OBS units along said path from the first storage location to the second deployment location, wherein the container is lifted no more than 6 feet above the deck as it is moved along said path;

f. providing an ROV adjacent said deployment position, wherein said ROV is capable of carrying a plurality of OBS units;

g. individually extracting at least two OBS units from a position within said container and moving said OBS units to said ROV; and h. causing said ROV to be launched from the marine vessel into the water.

11. The method of claim 10, wherein the step of individually extracting at least two OBS units from a position within said container and moving said OBS units to said ROV is accomplished with a deployment arm positioned at said second deployment location.

12. The method of claim 10, wherein the container being moved by said overhead gantry crane is lifted no more than 3 feet above the deck as it is moved along said path.

13. The method of claim 10, wherein the container being moved by said overhead gantry crane is lifted no more than 1 foot above the deck as it is moved along said path.

* * * * *